US006896630B1

(12) United States Patent
Breining

(10) Patent No.: US 6,896,630 B1
(45) Date of Patent: May 24, 2005

(54) MOTION TRAINING DEVICE

(76) Inventor: Fred Lawrence Breining, 965 Piermont Ct., Galt, CA (US) 95632-3430

( * ) Notice: Subject to any disclaimer, the term of this patent is extended or adjusted under 35 U.S.C. 154(b) by 0 days.

(21) Appl. No.: 10/374,654

(22) Filed: Feb. 26, 2003

Related U.S. Application Data

(60) Provisional application No. 60/363,971, filed on Mar. 13, 2002.

(51) Int. Cl.[7] ..... A63B 69/00

(52) U.S. Cl. ..... 473/422; 473/451

(58) Field of Search ..... 473/422, 423, 473/429, 430, 442, 443, 439, 451, 447; 482/83, 86, 87–90

(56) References Cited

U.S. PATENT DOCUMENTS 3,529,823 A * 9/1970 Garver ..... 473/418
5,071,122 A * 12/1991 Messina ..... 473/429
5,256,069 A * 10/1993 Snowden et al. ..... 434/247
5,303,914 A * 4/1994 Cooksey ..... 473/429
5,342,267 A * 8/1994 Adams et al. ..... 482/83
5,352,170 A * 10/1994 Condo et al. ..... 482/83
D356,127 S * 3/1995 Mara ..... D21/798
5,435,545 A * 7/1995 Marotta ..... 473/417
5,458,552 A * 10/1995 Mara ..... 482/90
5,800,291 A * 9/1998 Grover ..... 473/447
5,842,938 A * 12/1998 Garber ..... 473/430
6,280,351 B1 * 8/2001 Wong ..... 473/422
6,663,512 B2 * 12/2003 Martin ..... 473/452

* cited by examiner

*Primary Examiner*—Mitra Aryanpour
(74) *Attorney, Agent, or Firm*—Charles L. Thoeming; Jack Lo

(57) ABSTRACT

A motion training device is comprised of a plurality of targets attached to respective adjustable arms. The arms are attached to a support. The targets define a path for a part of the user's body to travel along. A method for using the motion training device is comprised of moving the targets to desired positions relative to each other to define a preferred path, and moving the part of the body being trained, such as a hand or foot, to strike all the targets in the proper sequence.

12 Claims, 4 Drawing Sheets

MOTION TRAINING DEVICE

CROSS REFERENCE TO RELATED APPLICATION

I claim the benefit of provisional patent application No. 60/363,971 filed on Mar. 13, 2002.

BACKGROUND OF THE INVENTION

1. Field of the Invention

The invention broadly relates to motion training devices.

2. Prior Art

Many physical activities require the hand or foot to move along certain paths. For example, the arm of a baseball player is moved along a preferred path when pitching a baseball. The arm is always moved along the same path to execute the same type of pitch. There is a preferred path for each type of activity. If the preferred path is followed, the activity will be more successful, for example, the pitch will be more accurate. Further, moving the body part along the preferred path may also minimize stress on the body.

Prior art training devices for ball related sports typically provide a single target, such as a tethered ball, for the user to hit. The user must determine the preferred path for the arm or leg to reach the target. The user can still hit the target even if the preferred path is not taken, so the training device does not help the user to learn the preferred path.

More sophisticated training devices, such as golf swing analysis systems, place tracking dots on the body. The user's motion is recorded on video and analyzed by a computer to show the path taken by the user. The results may be viewed by the user after the activity. Such systems are complicated and expensive. Further, they do not provide immediate feedback for the user while performing the activity.

BRIEF SUMMARY OF THE INVENTION

Accordingly, objects of the present motion training device are:

- to help train a user to move a body part along a preferred path;
- to provide instant feedback on whether the body part is traveling properly along the preferred path;
- to be adjustable for different users;
- to be adjustable to define different paths for the same activity; and
- to be adjustable to define different paths for different activities.

A motion training device is comprised of a plurality of targets attached to respective adjustable arms. The arms are attached to a support. The targets define a path for a part of the user's body to travel along. A method for using the motion training device is comprised of moving the targets to desired positions relative to each other to define a preferred path, and moving the part of the body being trained, such as a hand or foot, to strike all the targets in the proper sequence.

DRAWING REFERENCE NUMERALS

10. Target Pad
11. Target Pad
12. Target Pad
13. Flexible Arm
14. Flexible Arm
15. Flexible Arm
16. Preferred Path
17. Fastener
18. Support

DETAILED DESCRIPTION OF THE INVENTION

A preferred embodiment of the present invention for a motion training device is depicted in FIGS. 1–4. This preferred embodiment is comprised of a plurality of targets pads 10–12 attached to respective adjustably flexible arms 13–15. Target pads 10–12 are positioned to define a desired path 16 for a part of the user's body, such as a hand, to move along to perform a particular action, such as pitching a baseball, so as to train the user to move the body part properly. There may be any number of target pads, as long as there is more than one target pad.

Targets pads 10–12 are attached to flexible arms 13–15 by detachable fasteners 17. The target pads preferably comprise a tough fabric, such as denim or canvas. Alternatively, other types of target pads may be provided, such as soft cushions, flexible plastic sheets, or proximity sensors 19 that respond without contact, etc. (not shown). Flexible arms 13–15 comprise flexible jointed metal pipe goosenecks that are bendable into different shapes and retain such shapes when released. Alternatively, other types of adjustably flexible arms 13–15 may be used, such as hinged sections that can be tightened or locked in selected positions, and that include detents for repeatable positioning (not shown). Flexible arms 13–15 are attached to a support 18, which is preferably comprised of a tripod. Alternatively, other types of supports may be provided, such as a post embedded in the ground, a post embedded in a heavy base, a wall, a fence, etc. (not shown).

A method for using an embodiment of the motion training device is shown in FIGS. 1–4. The method is comprised of moving target pads 10–12 to desired positions relative to each other to define a preferred path 16 for a particular motion, which in this example is pitching a baseball with a hand. Target pads 10–12 may be moved to a variety of positions for people of different sizes, and for defining a variety of different paths for the same type of activity, or different activities.

Figure 1:
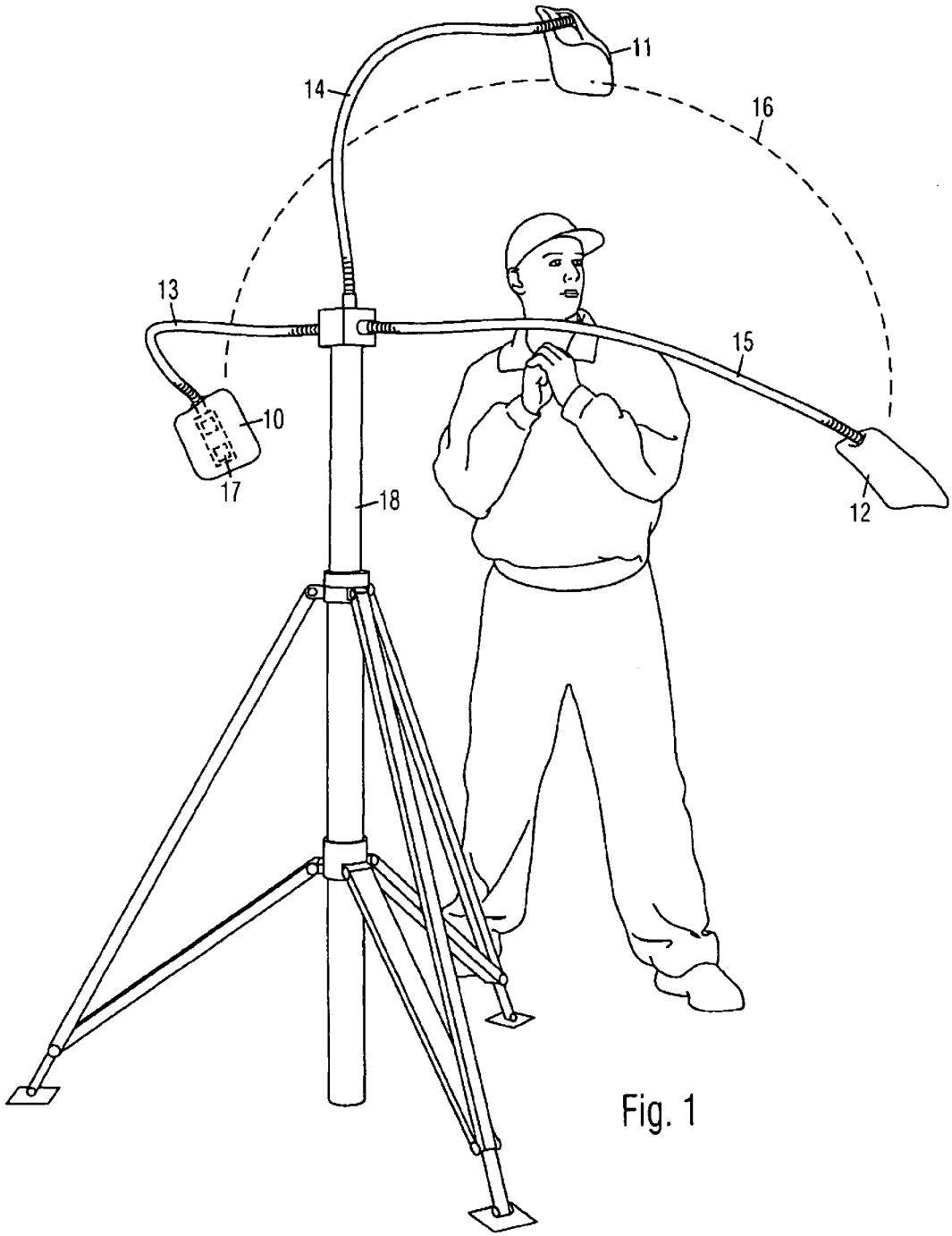
FIG. 1 is a perspective view of an embodiment of the present invention depicting the user in an initial position.
Figure 2:
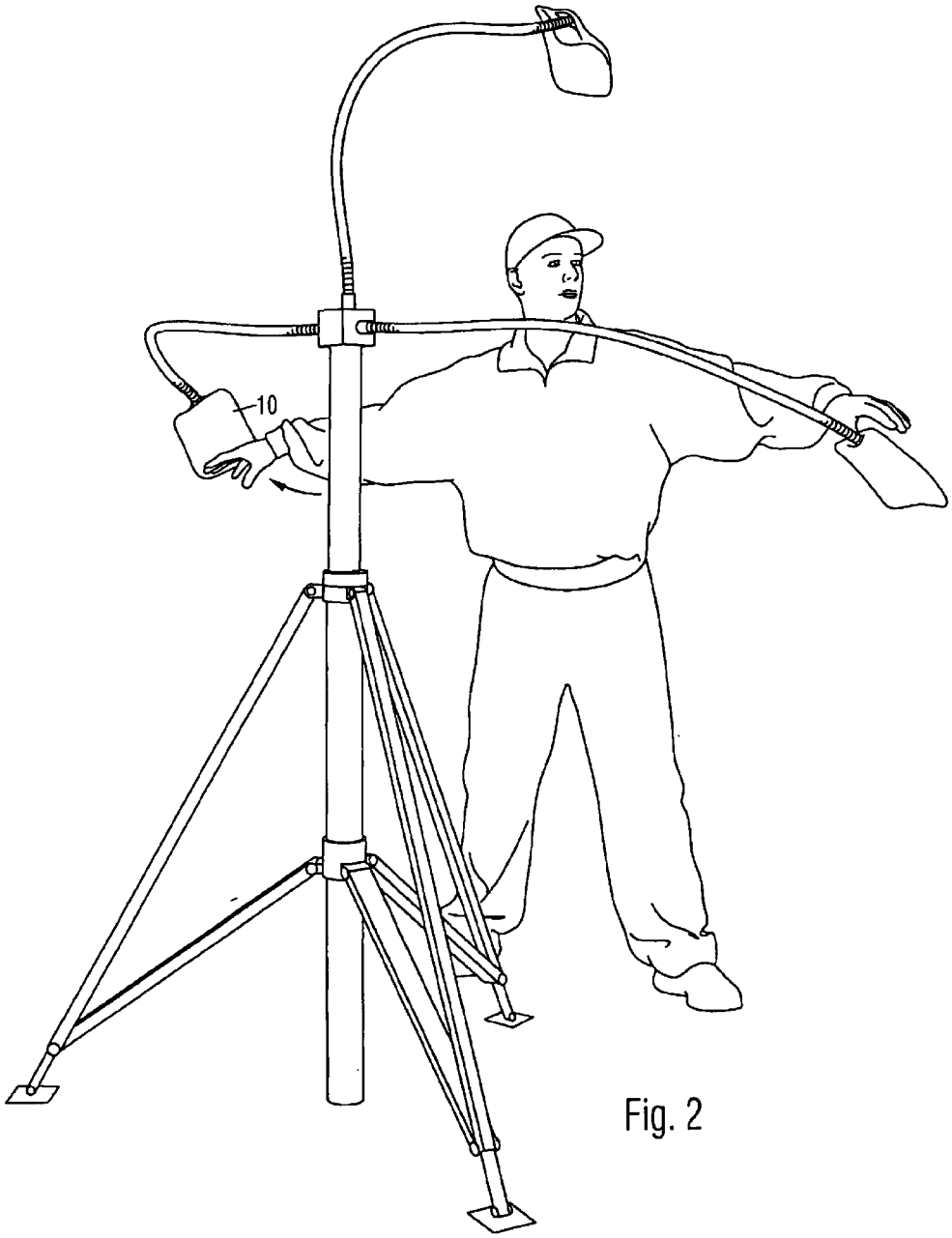
FIG. 2 shows the user striking a first target pad at the beginning of a preferred path defined by an embodiment of the present invention.
Figure 3:
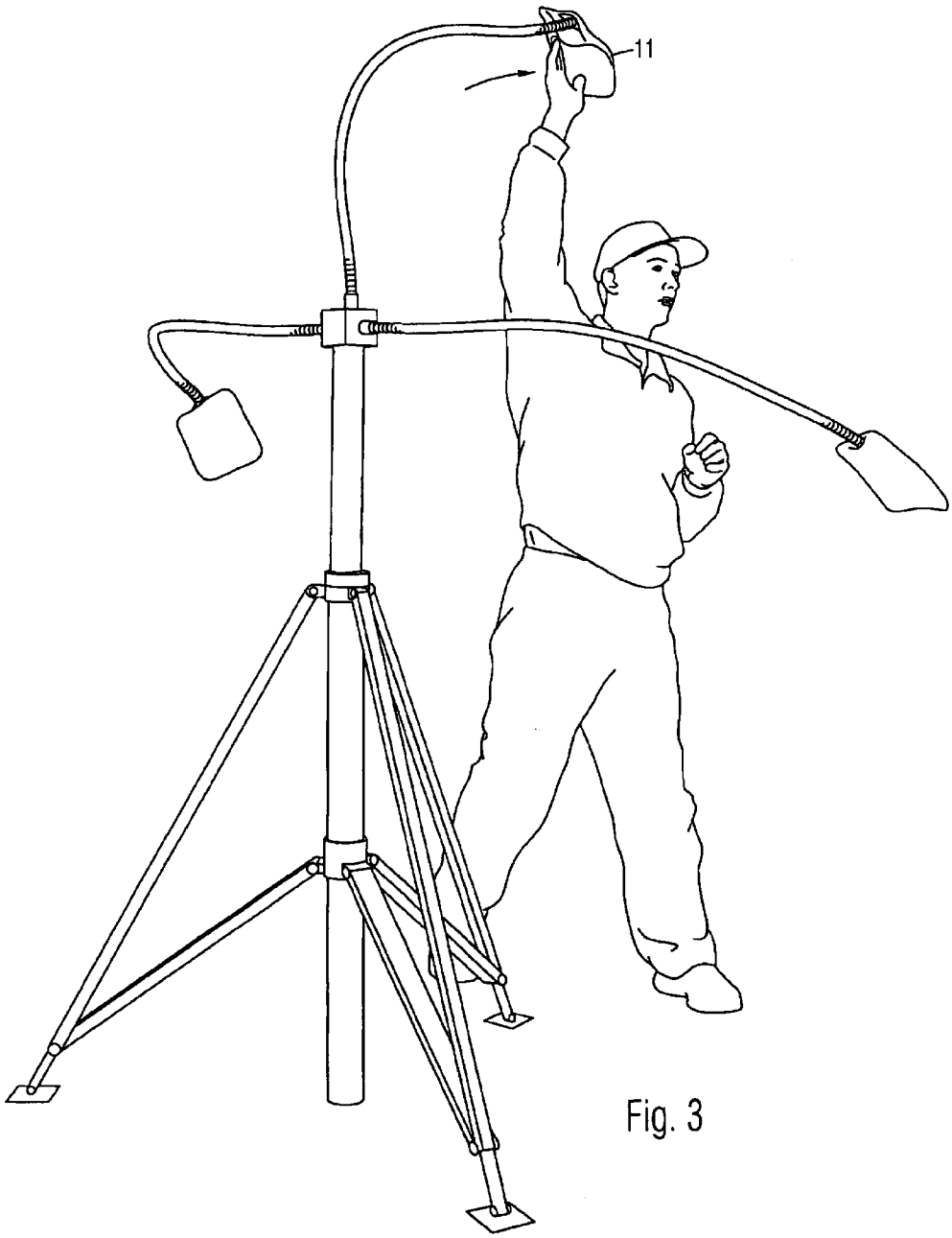
FIG. 3 shows the user-striking a second target pad along the path defined by an embodiment of the present invention.
Figure 4:
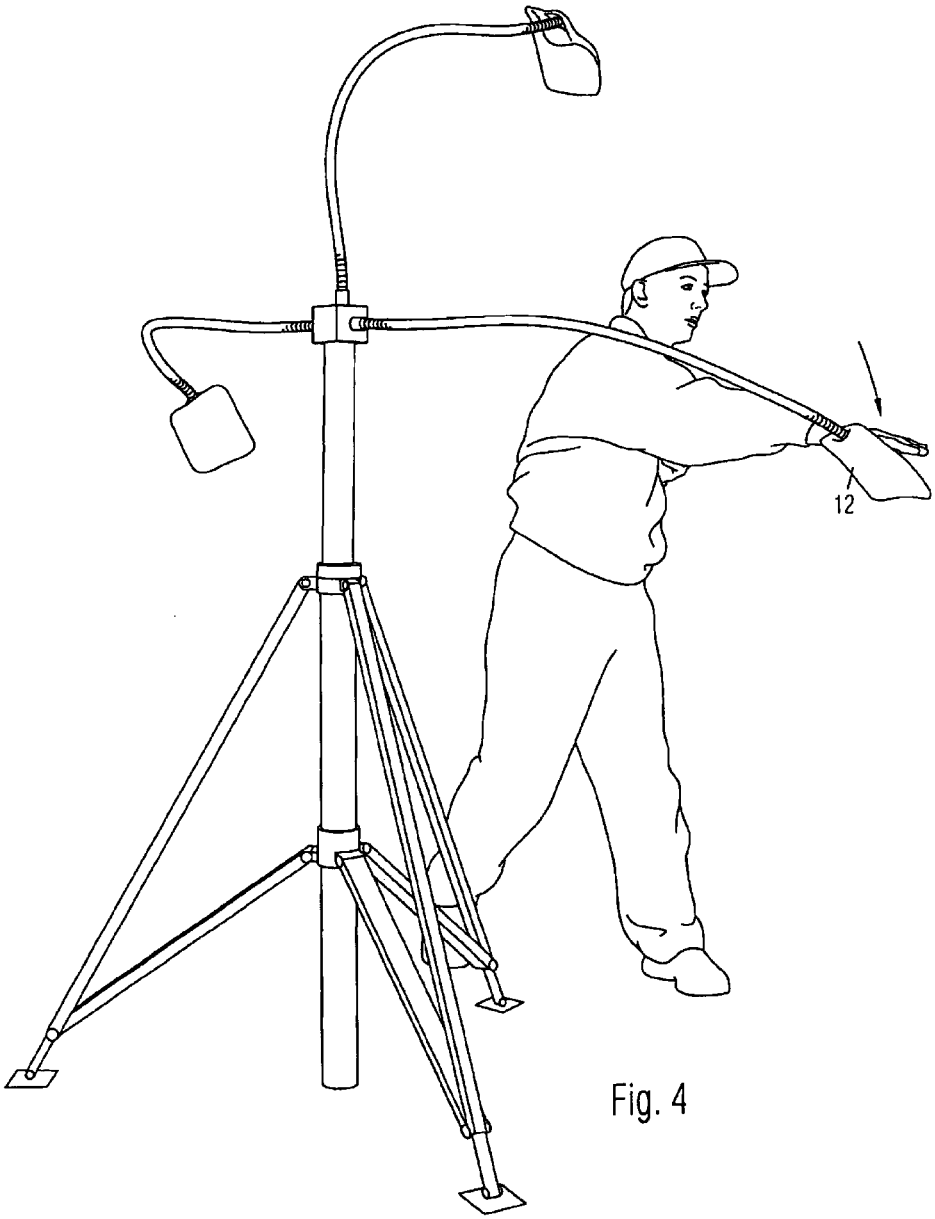
FIG. 4 shows the user striking a third target pad along the path defined by an embodiment of the present invention.

In FIG. 1, the user is in an initial position ready to perform the action. In FIGS. 2–3, the hand is moved along path 16 by sequentially striking target pads 10–12. The user instantly knows whether the action is performed along path 16 by sensing whether target pads 10–12 are all struck in sequence.

Accordingly, the present motion training device helps train a user to move a body part along a preferred path by positioning target pads along the path. The target pads provide instant feedback on whether the body part is traveling properly along the preferred path. The target pads are adjustable for different users. The target pads are adjustable to define different paths for the same activity. The target pads are also adjustable to define different paths for different activities.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A method for training a person to move a body part along a preferred path, the method comprising the steps of:

providing a plurality of adjustable arms, each arm capable of bending into different shapes and retaining the shape when released and having two ends; a plurality of target pads; fastener means to attach one target pad to one end of each arm; support means attached to each arm end not having a target pad, whereby the target pads can be spatially positioned to define a path of body motion; whereby the defined target pad positions are not altered from the path;

defining a predetermined path of body motion;

positioning the target pads of the apparatus along the defined path;

positioning a person to use the apparatus for the predetermined path of body motion whereby during the course of one cycle of motion along the path each target pad is struck only once in positional order relating to the path;

having the person complete one cycle of motion whereby each target pad is struck only once;

adjusting the path of target pads to the person's size requirements, if necessary; and repeating the cycles of motion whereby each target pad is struck only once per cycle until muscle memory for the person along the predetermined path of body motion has been achieved.

2. The method of claim 1, wherein the path is coplanar.

3. The method of claim 1, wherein the target pads comprise fabric from the group consisting of denim and canvas.

4. The method of claim 1, wherein the target pads comprise soft cushions.

5. The method of claim 1, wherein the target pads comprise flexible plastic sheets.

6. The method of claim 1, wherein the target pads comprise proximity sensors.

7. The method of claim 1, wherein fastener means is detachable.

8. The method of claim 1, wherein support means further comprises a center post.

9. The method of claim 8, further comprising a tripod.

10. The method of claim 1, wherein the adjustable arms comprise locking hinged means.

11. The method of claim 10, further comprising detents.

12. The method of claim 1, wherein the adjustable arms comprise flexible jointed metal pipe.

* * * * *